US005078293A

United States Patent [19]

Lippiello

[11] Patent Number: 5,078,293

[45] Date of Patent: Jan. 7, 1992

[54] SHOE SEAL FOR LIGHTWEIGHT FLOATING ROOF

[75] Inventor: Patrick L. Lippiello, Spring, Tex.

[73] Assignee: HMT, Inc., Houston, Tex.

[21] Appl. No.: 510,432

[22] Filed: Apr. 18, 1990

[51] Int. Cl.[5] ..... B65D 82/42

[52] U.S. Cl. ..... 220/221; 220/224

[58] Field of Search ..... 220/221, 222, 224, 218

[56] References Cited

U.S. PATENT DOCUMENTS

| | | | |
|---|---|---|---|
| 1,986,869 | 1/1935 | Welp | 220/224 |
| 2,464,804 | 3/1949 | Goldsby et al. | 220/224 |
| 2,649,985 | 8/1953 | Moyer | 220/224 |
| 2,784,863 | 3/1957 | Fabian | 220/224 |
| 2,790,574 | 4/1957 | Consani | 220/221 |
| 2,846,110 | 8/1958 | Stoyer | 220/224 |
| 2,981,438 | 4/1961 | Heisterberg | 220/219 |
| 3,167,206 | 1/1965 | Nelson | 220/224 |
| 4,126,243 | 11/1978 | Bruening | 220/226 X |
| 4,130,217 | 12/1978 | Hills et al. | 220/226 |
| 4,258,858 | 3/1981 | Russell | 220/218 X |
| 4,308,968 | 1/1982 | Thiltgen et al. | 220/224 |

*Primary Examiner*—Stephen Marcus
*Assistant Examiner*—Vanessa Caretto
*Attorney, Agent, or Firm*—Spensley Horn Jubas & Lubitz

[57] ABSTRACT

A shoe seal for sealing the space between a pontoon supported lightweight floating roof and the inner wall of an oil storage tank includes a plurality of hanger assemblies for movably mounting a shoe on the floating roof. The hanger assemblies are mounted in spaced-apart fashion around the outer rim of the floating roof, and each includes a support bracket coupled to the floating roof at an upper end thereof and having an opposite lower end pivotally coupled to a lever bracket. Each lever bracket has a first end pivotally coupled to the shoe by a shoe clip and an opposite second end disposed beneath the outer rim of the floating roof and having a float coupled thereto by a support strap. The floats which comprise hollow, enclosed, generally cylindrical members are disposed in spaced-apart fashion beneath the outer rim of the floating roof at a level below the pontoons which support the roof so as to be completely submerged within the oil or other liquid product stored within the tank. The resulting buoyant forces on the floats pivot the lever brackets in a direction so as to maintain the shoe in contact with the inner tank wall.

9 Claims, 3 Drawing Sheets

SHOE SEAL FOR LIGHTWEIGHT FLOATING ROOF

BACKGROUND OF THE INVENTION

The present invention relates to shoe seals for sealing the space between a floating roof and an inner tank wall within a storage tank.

HISTORY OF THE PRIOR ART

It is standard practice in the field of large storage tanks such as oil storage tanks having floating roofs to provide the floating roof with a seal. Such seals act to seal the space between the outer rim of the floating roof and the inner tank wall, while at the same time allowing the floating roof to rise or fall as the height of the liquid product within the storage tank varies. Such seals are necessary in order to prevent harmful hydrocarbon vapors from escaping through the space between the floating roof and the inner tank wall and entering the atmosphere.

Seals for floating roofs within storage tanks can assume a variety of different configurations. One such arrangement is shown in U.S. Pat. No. 4,308,968 of Thiltgen et al., which patent issued Jan. 5, 1982, and is commonly assigned with the present invention. The arrangement shown in the Thiltgen et al. patent includes two different seals, the first being a primary seal and the second being a backup or secondary seal. The use of a secondary seal such as the one shown in the Thiltgen et al. patent is sometimes necessary, due to the nature of the primary seal and to environmental requirements. The sealing arrangements shown in the Thiltgen et al. patent utilize vapor barriers in combination with flexible metal plates and wiper blades. The vapor barriers, which are common in many floating roof seals, comprise one or more layers of fabric which are generally impermeable to vapors from the liquid product stored in the tank.

One type of floating roof seal which has been found to be quite effective, and which usually eliminates the need for a secondary seal, is the shoe seal. Shoe seals employ a shoe in the form of a series of joined-together plates which are disposed against the inner wall of the tank and which are supported by the outer rim of the floating roof. A vapor barrier extending between the outer rim and the shoe provides an effective barrier to vapors from the liquid product in the tank, inasmuch as the lower portion of the shoe extends into the product.

Examples of shoe seals are provided by U.S. Pat. No. 2,981,438 of Heisterberg, which patent issued Apr. 25, 1961; U.S. Pat. No. 3,167,206 of Nelson, which patent issued Jan. 26, 1965; and U.S. Pat. No. 4,130,217 of Hills et al., which patent issued Dec. 19, 1978. In Heisterberg et al., the sealing mechanism is provided with a combination weatherhood and wax trough. The shoe is forced against the inner tank wall by spring-loaded pistons mounted within the outer rim of the floating roof. In Nelson, the shoe is suspended from the outer rim of the floating roof by a pivoting hanger structure designed to force the shoe against the inner tank wall. In Hills et al. various different members including springs are employed to maintain the shoe against the inner tank wall.

Certain storage tanks, particularly those which are enclosed by an overhead roof, are provided with lightweight roofs. Such roofs, which are typically of aluminum construction and which float on pontoons secured to the underside thereof, are suitable for such tank installations and have the advantages of simple construction and low cost. A major disadvantage of such lightweight roofs, however, is that they cannot support much weight because of the nature of their construction. This normally limits the type of seals which can be used with such lightweight roofs to those which are of relatively simple construction, and particularly those which are light in weight. A typical seal for such a lightweight roof will consist of a single flexible wiper blade mounted on the outer rim of the roof and extending into contact with the inner tank wall. Aside from being of limited effectiveness, such seals tend to deteriorate rather rapidly, requiring a frequent inspection cycle. In an effort to provide more complete and effective sealing of lightweight floating roofs, various secondary seals have been tried. The presence of such secondary seals enhances the sealing action, but usually at the expense of the added weight and complexity.

Shoe-type seals typically provide adequate sealing action without the need for a secondary seal, as previously noted. However, presently known shoe seals tend to be relatively heavy or may otherwise unduly stress the lightweight floating roofs so as to be generally unsuitable for use therewith. This is unfortunate. Not only are shoe seals effective, but they are of sufficient reliability so that the required inspection and maintenance cycle in association therewith is a relatively infrequent one. Accordingly, it would be desirable to provide an improved seal of relatively light weight which is suitable for use with lightweight floating roofs. Such seal should preferably be of the shoe-type so as to provide the effective sealing action associated therewith, while at the same time being of relatively simple, inexpensive and lightweight construction.

BRIEF DESCRIPTION OF THE INVENTION

The foregoing and other objects and features in accordance with the invention are accomplished by providing an improved shoe seal which effectively seals the space between the inner tank wall and the outer rim of a floating roof while at the same time being sufficiently light in weight and of sufficiently simple construction so as to be usable with lightweight floating roofs.

Shoe seals in accordance with the invention employ buoyant members in combination with hanger assemblies used to movably mount the shoe on the outer rim of the floating roof. The buoyant members are coupled to pivot elongated lever members pivotally coupled to the outer rim of the floating roof as well as being coupled to the shoe. The forces exerted on the buoyant members by a liquid product within the storage tank rotate the lever members in a direction which maintains the shoe against the inner tank wall. Such a sealing arrangement is of simple construction and light in weight, making it ideally suited for lightweight roofs. In addition, the buoyancy of the buoyant members acts to compensate for at least some of the weight of the sealing arrangement, such that the weight of the sealing arrangement has little or no effect on the floating roof.

In a preferred embodiment of a shoe seal according to the invention a plurality of hanger assemblies are mounted on the outer rim of the floating roof in spaced-apart fashion. Each hanger assembly has a generally vertically disposed support bracket coupled to the floating roof at an upper end thereof and extending downwardly to a lower end. Each hanger assembly also includes a lever member in the form of a lever bracket having an intermediate portion pivotally coupled to the lower end of the support bracket, a first end pivotally coupled to the shoe by a shoe clip mounted on the shoe and pivotally coupled thereto, and an opposite second end disposed beneath the outer rim of the floating roof. The buoyant members comprise floats, with each being coupled to the second end of the lever bracket of a different hanger assembly. Each float is comprised of a hollow, generally cylindrical member having cover plates sealed to the opposite ends thereof. A support strap encircles an intermediate portion of the float between the opposite cover plates and has opposite ends coupled to the second end of the lever bracket.

The buoyancy of the sealed hollow floats causes upward forces which pivot the lever brackets in a direction to maintain the shoe in contact with the inner tank wall. At the same time, such upward forces compensate for at least some of the weight of the seal. The second ends of the lever brackets are disposed beneath the outer rim of the floating roof, and the floats are coupled to the undersides of such second ends. This disposes the floats well below the pontoons which support the lightweight floating roof so that the floats are completely submerged within the liquid product in the storage tank. This enhances the upward forces on the floats.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION OF THE INVENTION

Figure 1:
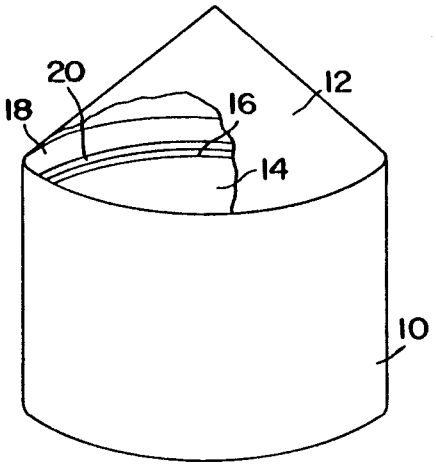
FIG. 1 is a perspective view, partly broken away, of an oil storage tank having a lightweight floating roof and a shoe seal in accordance with the invention between the outer rim of the floating roof and the inner tank wall.

FIG. 1 depicts a storage tank 10 which is of the enclosed type so as to have an overhead roof 12. A floating roof 14 beneath the overhead roof 12 floats on top of a liquid product such as oil stored within the tank 10.

To prevent hydrocarbon vapors from escaping into the atmosphere from the space between an outer rim 16 of the floating roof 14 and an inner tank wall 18, a seal 20 is provided. The seal 20 extends between the outer rim 16 of the floating roof 14 and the inner tank wall 18 around the circumference of the floating roof 14, and acts as a barrier to hydrocarbon vapors. The seal 20 must be capable of movement up and down the inner tank wall 18 while maintaining a sealing relationship therewith, so that the floating roof 14 may rise or fall with the varying quantities of the liquid product in the tank 10.

The floating roof 14 is of the lightweight type frequently used in enclosed storage tanks. Such lightweight floating roofs are typically of aluminum construction and are supported by pontoons attached to the underside thereof and which float on the surface of the liquid product in the storage tank.

As described in detail hereafter, the seal 20 is of the shoe type in which a series of plates joined together and extending around the circumference of the lightweight floating roof 14, form a shoe which is mounted on the outer rim 16 of the lightweight floating roof 14. Shoe seals in accordance with the invention employ hanger assemblies in combination with hollow floats which when submerged in the liquid product exert a bouyant force on the hanger assemblies so as to maintain the shoe in engagement with the inner tank wall 18.

Figure 2:
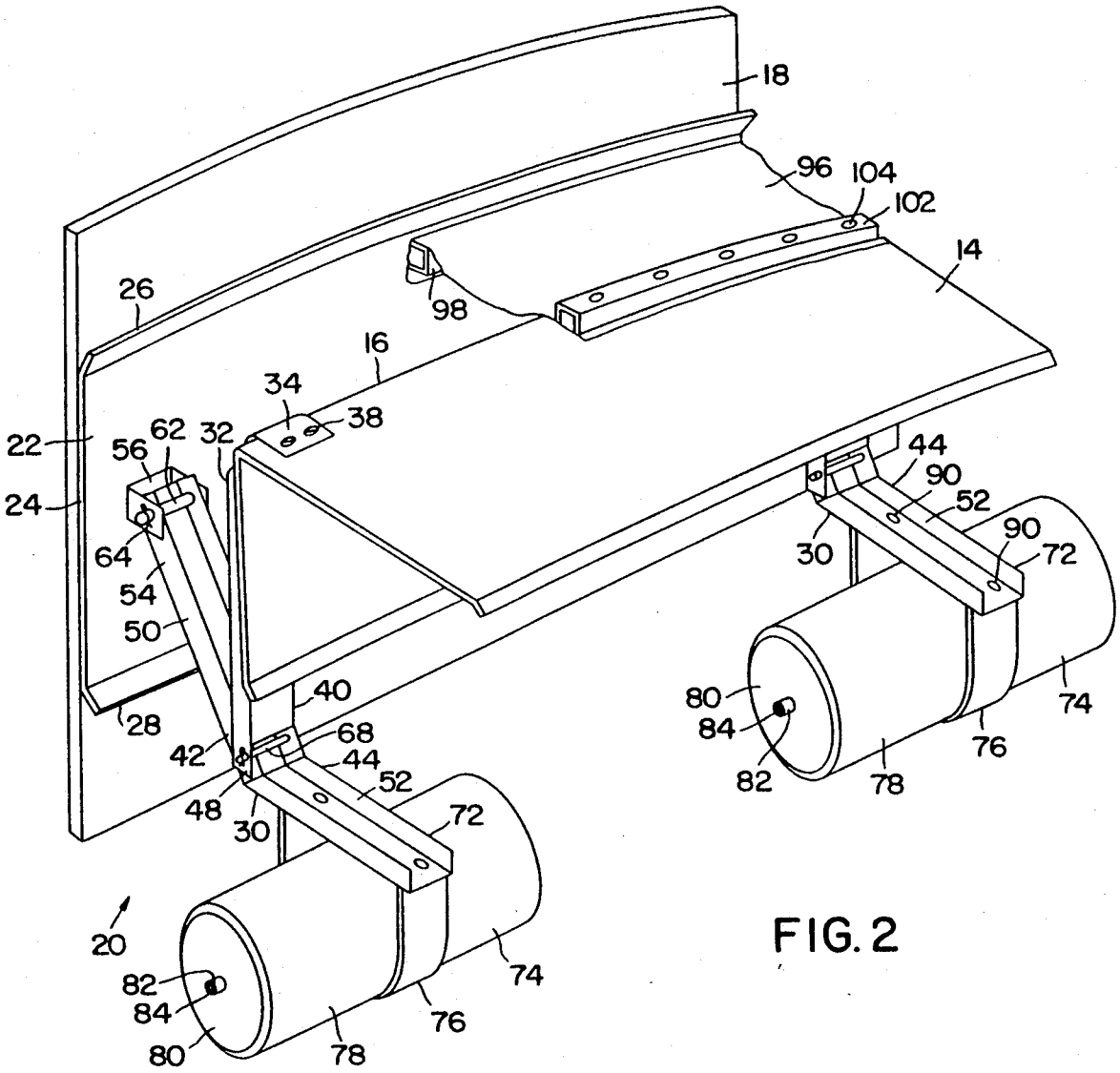
FIG. 2 is a perspective view, partly broken away, of adjacent portions of the inner tank wall and the outer rim of the floating roof of the storage tank of FIG. 1, showing the details of the shoe seal in accordance with the invention.
Figure 3:
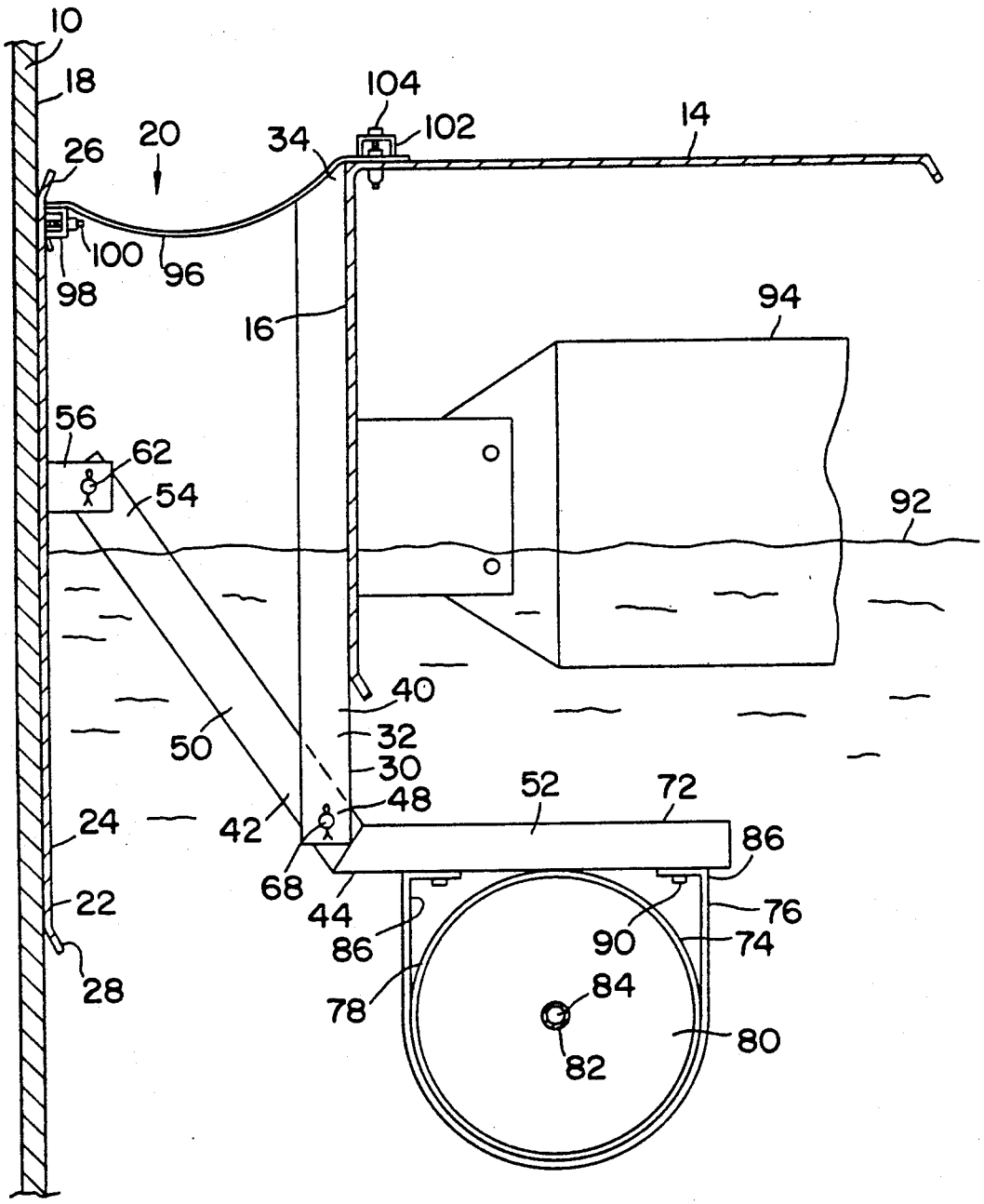
FIG. 3 is a side sectional view of the shoe seal of FIG. 2.
Figure 4:
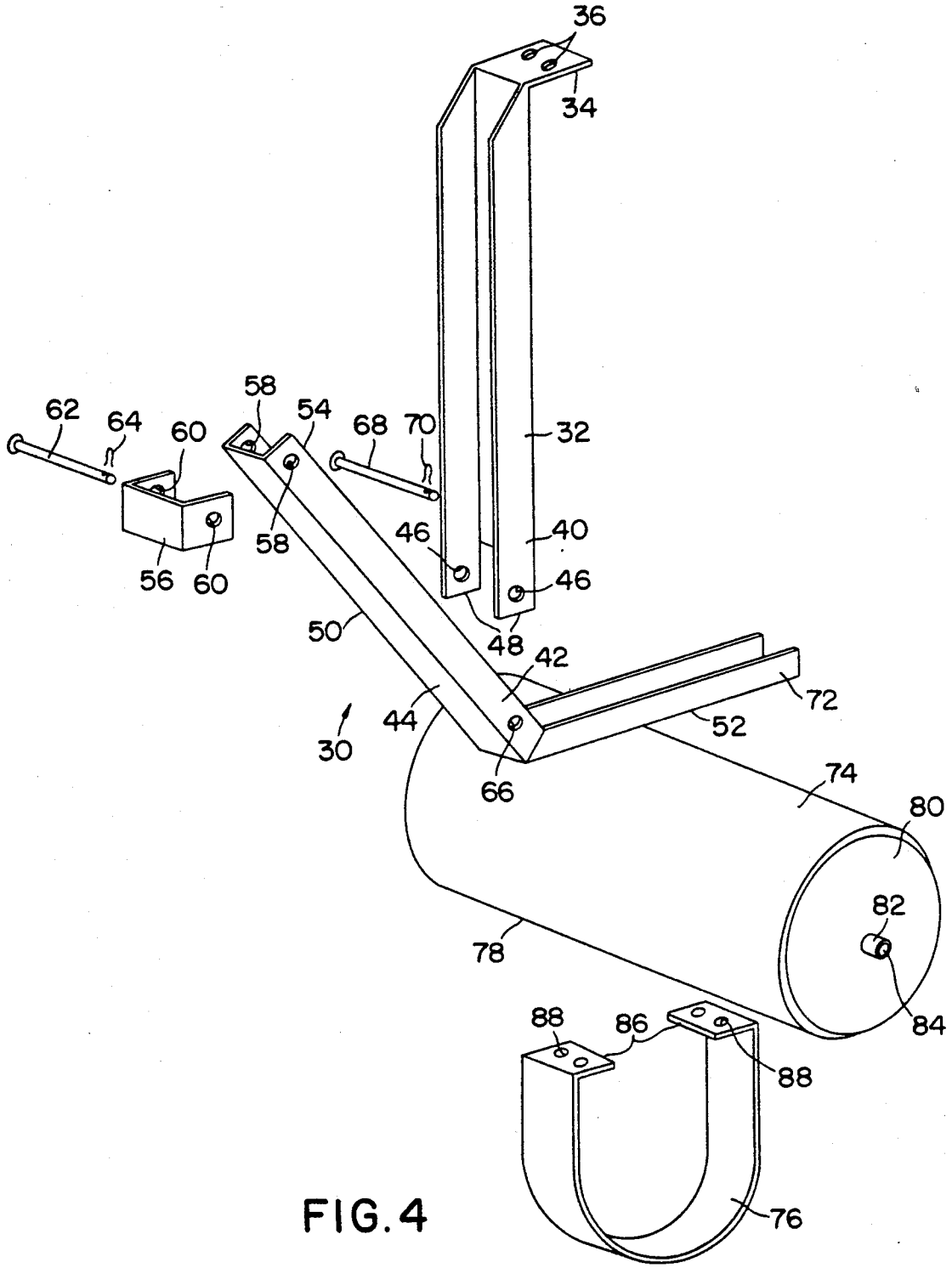
FIG. 4 is a perspective, exploded view of one of the hanger assemblies and the associated float of the shoe seal of FIG. 2.

FIGS. 2–4 show the seal 20 in detail. The seal 20 includes a shoe 22 which is comprised of a series of metal plates 24 joined together at their opposite ends in conventional shoe seal fashion. FIGS. 2 and 3 show one of the plates 24 which includes an inwardly extending upper lip 26 along an upper edge thereof, and an inwardly extending opposite lower lip 28 along a lower edge thereof. The upper and lower lips 26 and 28 facilitate upward and downward movement of the plates 24 along the inner tank wall 18. The storage tank 10 can be either of the riveted type or the welded type. In the case of a riveted tank, the metal plates forming such tank are joined together by rivets, the heads of which protrude from the inner tank wall 18. The shoe 22 is designed to slide over the rivets of such tanks. In the case of welded storage tanks, the metal plates comprising the tank are welded together. In that event, the shoe 22 is capable of sliding over the inner tank wall 18, including the welded seams of such wall.

In addition to the shoe 22, the seal 20 includes a plurality of hanger assemblies 30 mounted in spaced-apart fashion about the outer rim 16 of the floating roof 14. Each hanger assembly 30 includes an elongated support bracket 32 which is generally vertically disposed against the outer rim 16 and which has an upper end 34 thereof. The upper end 34 is provided with a pair of apertures 36 therein for receiving bolts 38 to mount the support bracket 32 on the floating roof 14. The support bracket 32 has a lower end 40 opposite the upper end 34 which is pivotally coupled to an intermediate portion 42 of an elongated lever bracket 44 within the hanger assembly 30. The pivotal coupling is accomplished by apertures 46 within opposite legs 48 at the lower end 40.

The lever bracket 44 is comprised of opposite elongated portions 50 and 52 which are joined together at the intermediate portion 42 and which form an acute angle with each other. The elongated portion 50 terminates at a first end 54 of the lever bracket 44 which is pivotally coupled to the shoe plate 24 by a generally U-shaped shoe clip 56 coupled to the shoe plate 24 such as by bolting. The first end 54 of the elongated portion 50 has opposite apertures 58 therein, and the shoe clip 56 has opposite apertures 60 therein. The pivotal coupling of the first end 54 of the lever bracket 44 to the shoe plate 24 is accomplished using a pin 62 which extends through the apertures 58 and 60 and which receives a cotter pin 64 in one end thereof.

The intermediate portion 42 of the lever bracket 44 is provided with opposite apertures 66. The lower end 40 of the support bracket is pivotally coupled to the intermediate portion 42 of the lever bracket 44 using a pin 68 which extends through the apertures 46 in the legs 48 and through the apertures 66 in the intermediate portion 42 of the lever bracket 44. The pin 68 receives a cotter pin 70 in one end thereof, to hold the pin 68 in place.

The elongated portion 52 of the lever bracket 44 terminates in a second end 72. A float 74 is coupled to the second end 72 of the lever bracket 44 by a support strap 76. The float 74 is comprised of a hollow, generally cylindrical tube 78, having a pair of cover plates 80 sealed to the opposite ends therof. A coupling 82 having a removable plug 84 therein is mounted in one of the cover plates 80.

The support strap 76 encircles an intermediate portion of the tube 78 of the float 74 between opposite ends 86 thereof. The opposite ends 86 are provided with apertures 88 for receiving bolts 90 to couple the opposite ends 86 to the second end 72 of the lever bracket 44. In this manner the float 74 is coupled to the second end 72 of the lever bracket 44.

The hollow floats 74 comprise bouyant members which, when at least partially submerged in a liquid product stored in the tank 10, provide a substantial upward force on the second end 72 of the lever bracket 44. The opposite cover plates 80 of each float 74 are sealed to the tube 78, and the effectiveness of such seal may be checked by removing the plug 84 from the coupling 82 at one end of the float 74 and blowing air into the float 74 to check for leaks.

As perhaps best shown in FIG. 2, each of the hanger assemblies 30 has a different float 74 coupled thereto. This disposes the floats 74 in spaced-apart fashion about the outer circumference of the floating roof 14 at the outer rim 16. The hanger assemblies 30 mount the shoe 22 on the floating roof 14 in movable fashion so that the shoe 22 can move as necessary relative to the floating roof 14 to accomodate a varying space between the outer rim 16 of the floating roof 14 and the inner tank wall 18. The upward forces on the second ends 72 of the lever brackets 44 provided by the buoyant floats 74 pivot the lever brackets 44 so as to maintain the shoe 22 in contact with the inner tank wall 18.

The side sectional view of FIG. 3 shows the liquid product 92 within the storage tank 10 on which the floating roof 14 floats. The roof 14 floats on the liquid product 92 by virtue of a plurality of pontoons secured to the underside of the roof 14. One such pontoon 94 is shown in FIG. 3. The pontoons 94, which are usually mounted at the underside of the floating roof 14 in spaced-apart, generally parallel fashion, are eliminated from FIG. 2 for simplicity of illustration.

FIG. 3 illustrates the manner in which the floats 74 are disposed by the hanger assemblies 30 in positions beneath the outer circumference of the floating roof 14 so as to be completely immersed within the liquid product 92. Such complete immersion of the floats 74 maximizes the upward forces on the second ends 72 of the lever brackets 44, due to the buoyancy of the floats 74. As a result, not only do such upward forces maintain the shoe 22 in contact with the inner tank wall 18, but they also provide substantial if not total compensation for the weight of the seal 20 on the floating roof 14. As previously noted, most lightweight floating roofs are not capable of supporting very much weight. The shoe seals 20 of the present invention are relatively light in weight so as not to overload a lightweight floating roof. Nevertheless, the relatively small amount of weight of the seal 20 is substantially compensated for by the upward forces provided by the bouyancy of the floats 74.

One reason for the effectiveness of shoe seals is that the lower part of the shoe is immersed in the liquid product. Consequently, if the space between the outer rim 16 of the floating roof 14 and the shoe 22 is sealed against the escape of vapors from the liquid product, then escape of vapors from the liquid product into the atmosphere above the floating roof 14 is all but eliminated. Inasmuch as the shoe 22 is maintained in contact with the inner tank wall 18 by action of the hanger assemblies 30 and the included floats 74, escape of vapors from the liquid product through the interface of the shoe 22 and the inner tank wall 18 is negligable.

The space between the outer rim 16 of the floating roof 14 and the shoe 22 is sealed by a flexible vapor barrier provided by a length of vapor impermeable fabric 96. One edge of the fabric 96 is coupled to the shoe 22 along a top portion of the shoe 22 just beneath the upper lip 26. This is accomplished by a channel 98 and a plurality of bolts 100. The bolts 100 extend through the shoe 22, through the fabric 96 and through the channel 98. An opposite edge of the fabric 96 is secured to the outer rim 16 of the floating roof 14 by a channel 102 and a plurality of bolts 104. The bolts 104 extend through the channel 102, the fabric 96 and into the floating roof 14.

While the invention has been particularly shown and described with reference to a preferred embodiment thereof, it will be understood by those skilled in the art that other changes in form and details may be made therein without departing from the spirit and scope of the invention.

What is claimed is:

1. An arrangement for mounting a shoe on a floating roof in a storage tank and maintaining the shoe in contact with an inner wall of the tank, comprising the combination of:

a plurality of hanger assemblies disposed about an outer rim of the floating roof, each of the hanger assemblies being coupled to the shoe and being pivotally coupled to the floating roof;

a plurality of bouyant members, each being coupled to a different one of the hanger assemblies and being operative to pivot the associated hanger assembly in a direction to force the shoe into contact with the inner wall when at least partially submerged in a liquid product in the storage tank;

the floating roof including a plurality of pontoons which float on the surface of a liquid product stored in the storage tank; and the plurality of bouyant members being disposed by the hanger assemblies to which they are coupled in locations substantially below the plurality of pontoons so as to be completely submerged in the liquid product.

2. An arrangement for mounting a shoe on a floating roof in a storage tank and maintaining the shoe in contact with an inner wall of the tank, comprising the combination of:

a plurality of hanger assemblies disposed about an outer rim of the floating roof, each of the hanger assemblies being coupled to the shoe and being pivotally coupled to the floating roof;

a plurality of buoyant members, each being coupled to a different one of the hanger assemblies and being operative to pivot the associated hanger assembly in a direction to force the shoe into contact with the inner wall when at least partially submerged in a liquid product in the storage tank;

each of the plurality of hanger assemblies comprising a support bracket mounted on the floating roof, a shoe clip coupled to the shoe, and a lever bracket having an intermediate portion pivotally coupled to the support bracket and having a first end pivotally coupled to the shoe clip and an opposite second end coupled to one of the plurality of buoyant members; and a support strap mounted on the second end of the lever bracket and adapted to secure one of the plurality of buoyant members therein.

3. An arrangement for mounting a shoe on a floating roof in a storage tank and maintaining the shoe in contact with an inner wall of the tank, comprising the combination of:

a plurality of hanger assemblies disposed about an outer rim of the floating roof, each of the hanger assemblies being coupled to the shoe and being pivotally coupled to the floating roof; and a plurality of buoyant members, each being coupled to a different one of the hanger assemblies and being operative to pivot the associated hanger assembly in a direction to force the shoe into contact with the inner wall when at least partially submerged in a liquid product in the storage tank, each of the plurality of buoyant members comprising a float having a hollow, generally cylindrical tube and a pair of cover plates sealed to opposite ends of the tube.

4. The invention set forth in claim 3, further including a removable plug mounted in one of the pair of cover plates.

5. An arrangement for mounting a sealing shoe on the outer rim of a floating roof in a tank, the floating roof having a plurality of pontoons for floating the roof on the surface of a liquid product stored in the tank, comprising the combination of:

a plurality of lever brackets, each having an intermediate portion pivotally coupled to the lower end of a different one of a plurality of support brackets, a first end coupled to a shoe and an opposite second end extending beneath an outer rim of a floating roof; and a plurality of floats, each mounted on the second end of a different one of the plurality of lever brackets.

6. The invention set forth in claim 5, wherein each of the lever brackets is comprised of opposite first and second portions joined together at an acute angle, the first portion terminating in the first end and the second portion terminating in the second end.

7. The invention set forth in claim 5, wherein each of the lever brackets is coupled to the shoe by a different one of a plurality of shoe clips mounted on the shoe and pivotally coupled to the first end of the lever bracket.

8. The invention set forth in claim 5, wherein each of the floats is comprised of a hollow, enclosed, generally cylindrical member coupled to the second end of an associated one of the lever brackets by a support strap encircling the generally cylindrical member at an intermediate portion thereof and having opposite ends coupled to the second end of the associated lever bracket.

9. The invention set forth in claim 8, wherein each of the floats is completely submerged in a liquid product stored in a tank.

* * * * *